US007823732B2

(12) United States Patent
Lutkauskas et al.

(10) Patent No.: US 7,823,732 B2
(45) Date of Patent: Nov. 2, 2010

(54) STORAGE AND DISPLAY CARTON WITH MULTIPLE DISPLAY ORIENTATIONS

(75) Inventors: Todd A. Lutkauskas, St. Paul, MN (US); Joel A. Vokaty, St. Louis Park, MN (US); Craig D. Schinzer, Lakeville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 918 days.

(21) Appl. No.: 11/145,408

(22) Filed: Jun. 3, 2005

(65) Prior Publication Data

US 2006/0283722 A1 Dec. 21, 2006

(51) Int. Cl.
*B65D 25/54* (2006.01)

(52) U.S. Cl. ..... 206/772; 206/774; 206/781; 229/162.7

(58) Field of Classification Search ..... 206/736, 206/774, 769, 781, 782, 434, 746, 772; 229/121, 229/162.6, 162.7
See application file for complete search history.

(56) References Cited

U.S. PATENT DOCUMENTS

| | | | | |
|---|---|---|---|---|
| 3,669,251 | A | 6/1972 | Phillips, Jr. | |
| 4,116,330 | A | 9/1978 | Ellis | |
| 4,191,288 | A * | 3/1980 | Hostad | 206/764 |
| 4,401,255 | A * | 8/1983 | Conroy et al. | 229/155 |
| 4,948,036 | A * | 8/1990 | Loughman | 229/117.14 |
| 5,289,916 | A * | 3/1994 | Mickelberg | 206/756 |
| 5,657,872 | A * | 8/1997 | Leftwich et al. | 206/738 |
| 5,881,884 | A | 3/1999 | Podosek | |
| 6,135,289 | A | 10/2000 | Miller | |
| 6,168,027 | B1 | 1/2001 | Esser | |
| 6,405,921 | B1 * | 6/2002 | Cochrane | 229/242 |
| 2004/0094452 | A1 * | 5/2004 | Scott et al. | 206/769 |

FOREIGN PATENT DOCUMENTS

| | | | |
|---|---|---|---|
| DE | 1890978 | U | 4/1964 |
| DE | 20204791 | U1 | 8/2002 |

* cited by examiner

*Primary Examiner*—Jila M Mohandesi
*Assistant Examiner*—Sharon M Prange
(74) *Attorney, Agent, or Firm*—David B. Patchett

(57) ABSTRACT

A carton for storing and displaying a plurality of articles including a bottom panel, front and rear panels, first and second side panels, and a top panel. The front and rear panels extend from opposing first and second edges of the bottom panel. The first and second side panels extend from opposing third and fourth edges of the bottom panel. The top panel extends from the rear and second side panels opposite the bottom panel. A gap is defined between corresponding edges of the first side panel and the front panel. A front face is at least partially defined by the front panel, a side face is at least partially defined by the first side panel, and a top face is at least partially defined by the top panel. The carton is configured to permit viewing of contained articles from the front face, the side face, and the top face.

31 Claims, 8 Drawing Sheets

STORAGE AND DISPLAY CARTON WITH MULTIPLE DISPLAY ORIENTATIONS

BACKGROUND

The present invention relates to cartons for use in storing and displaying a plurality of articles. More particularly, it relates to cartons providing multiple different storage and display orientations.

Containers, including paperboard cartons or boxes, have been used for many years to transport and store individually packaged articles. Typically, several individually packaged articles are packed within a single paperboard box that is provided with a removable lid or an integral folded top that is sealed. The packaged articles are generally transported within the closed or sealed box from the manufacturing facility to a place of retail sale. In order to present the packaged articles for retail sale, store personnel must first remove the lid or open the sealed top, remove each individually packaged article from the box, properly position each individually packaged article on available display shelves, and finally discard the box. Thus, transporting packaged articles from a manufacturing facility to a storage location and then to a display location using conventional paperboard cartons or boxes is a labor-intensive process, and may require uniquely configured display shelf constructions depending upon a shape and/or size of the packaged articles.

Alternatively, efforts have been made to provide cartons that are useful not only for shipping and storing contained articles, but also for displaying the articles at the place of retail sale. These designs typically entail the box or carton having a "convertible" feature whereby a portion of the box is removed (e.g., along perforation or tear lines) from a remainder thereof to thus partially "expose" or display articles contained within the converted box. The so-converted box/articles can then be placed on a shelf or other desired surface at the retail store. For example, U.S. Pat. No. 5,881,884 to Podosek describes a shipping and display carton having a series of tear lines in various panels thereof that allow a top panel, and portions of a front and opposing side panels, to be removed from a remainder of the box, thus displaying contained articles. Other references, such as U.S. Pat. No. 4,116,330 to Ellis; U.S. Pat. No. 3,669,251 to Phillips, Jr.; U.S. Pat. No. 6,135,289 to Miller; and U.S. Pat. No. 6,168,027 to Esser follow this same general approach.

While these and other carton designs are viable, certain drawbacks exist. In particular, conventional storage and display cartons (whether "convertible" design or different style) allow for only one useable display orientation on the retailer's shelf. For example, and with reference to prior art carton 10 of FIG. 1 (that otherwise is a copy of a figure of U.S. Pat. No. 5,881,884), where the carton 10 (initially provided in a shipping configuration whereby a completely enclosed box is defined) is used to display contained articles 11, the top panel 12 is entirely removed along with a portion of the front panel 13, resulting in a converted or display carton 10*a*. To display the articles 11, the carton 10*a* must be oriented (e.g., on a retailer's shelf) such that a front face 14 (referenced generally in FIG. 1) "faces" potential purchasers. This limitation results from the contained articles 11 being obscured at all other sides or faces 15 of the converted carton 10*a* other than at the partially "open" front 14 and the "open" top 16 (referenced generally in FIG. 1). Further, because the top 16 is completely "open", the converted carton 10*a* cannot be laid on one of its sides 15 or back 17 (referenced generally) as the contained articles 11 would inherently and readily fall out of the converted carton 10*a*.

These inherent display orientation constraints can be quite problematic in various retail environments. As a general statement, many articles sold to consumers are not square cubes, nor are they packaged in square-cubed packaging. Thus, the storage and display carton (for example, the converted carton 11*a* of FIG. 1) will have a rectangular shape, meaning that various sides thereof have differing widths (e.g., the front and back faces 14, 17 are wider than the opposing side faces 15). With conventional display carton 10*a* designs, the carton must be oriented such that the "wider" front face 14 (as compared to the "narrower" sides 15) of the carton "faces" potential purchasers, thus occupying valuable shelf space. For some retailers, shelving constraints and/or consumer display preferences may dictate a different, more desirable carton orientation whereby one of the smaller width sides 15 of the carton 10*a* "faces" the consumer (and thus the carton 10*a* occupies less shelf length). Unfortunately, because the carton sides 15 obscure the contained articles 11, this desired orientation is effectively unavailable. In addition, because contained articles 11 can only be removed via the "open" top 16 of the carton 10*a*, a fairly substantial space must exist between the carton top 16 and any shelf positioned above the carton 10*a*. This, in turn, limits the usable vertical shelf space available to the retailer.

Cartons exist by which retailers can store and display contained articles. However, conventional designs overtly limit an on-the-shelf orientation of the display carton. Thus, a need exists for an improved storage and display carton offering retailers greater flexibility in the manner in which the display carton can be situated on a shelf or other surface.

SUMMARY

One aspect of the present invention relates to a carton for storing and displaying a plurality of articles. The carton includes a bottom panel, opposing front and rear panels, opposing first and second side panels, and a top panel. The front and rear panels extend from opposing first and second edges, respectively, of the bottom panel. Similarly, the first and second side panels extend from opposing third and fourth edges, respectively, of the bottom panel. Finally, the top panel extends from the rear and second side panels opposite the bottom panel. A gap is defined between corresponding lateral edges of the first side panel and the front panel. Further, a front face is at least partially defined by the front panel, a side face is at least partially defined by the first side panel, and a top face is at least partially defined by the top panel. With these conventions in mind, the carton is configured to permit viewing of contained articles from the front face, the side face, and the top face. In one embodiment, the corresponding lateral edges of the front panel and the first side panel extend in a perpendicular fashion from the bottom panel such that the gap extends to the bottom panel. In another embodiment, the carton further includes a removable cover apart from the top panel.

Yet another aspect of the present invention relates to a combination carton and articles. The carton includes a bottom panel, opposing front and rear panels, opposing first and second side panels, and a top panel. The front and rear panels extend from opposing first and second edges, respectively, of the bottom panel. The first and second side panels extend from opposing third and fourth edges, respectively, of the bottom panel. The top panel extends from the rear and side panels opposite the bottom panel. A gap is defined between corresponding lateral edges of the first side panel and the front panel. Further, the carton has a front face at least partially defined by the front panel, a side face at least partially defined by the first side panel, and a top face at least partially defined by the top panel. The plurality of articles are contained within the carton. With this in mind, the carton and articles are configured such that at least one of the contained articles is visible from an exterior of the carton at the front face, the side face, and the top face. Further, at least one of the articles can be removed from the container through the gap. In one preferred embodiment, the gap has a width commensurate with an outer dimension of one of the contained articles.

Yet another aspect of the present invention relates to a carton for storing and displaying a plurality of articles. The carton includes a bottom panel, a rear panel, a first side panel, a second side panel, a front panel, and a top panel. The bottom panel has opposing first and second edges and opposing third and fourth edges. The rear panel extends from the second edge and defines opposing lateral edges and a leading edge opposite the bottom panel. To this end, extension from the bottom panel to the leading edge defines a height of the rear panel. The front panel extends from, and along an entirety of, the first edge of the bottom panel and defines a leading edge (opposite the bottom panel) and opposing lateral edges. Extension of the front panel from the bottom panel to the leading edge defines a height of the front panel, with this height being less than the height of the rear panel and differing at the opposing lateral edges thereof. The first side panel extends from, and along a portion of, the bottom panel third edge to a leading edge opposite the bottom panel. In this regard, extension of the first side panel from the bottom panel to the leading edge defines a height of the front panel, with this height being less than the height of the rear panel. Further, the first side panel defines opposing lateral edges, one of which contacts the lateral edge of the rear panel and the other of which is spaced from a corresponding lateral edge of the front panel to define a gap. The second side panel extends from, and along an entirety of, the fourth edge of the bottom panel (opposite the first side panel) to a leading edge. Extension of the second side panel from the bottom panel to the leading edge defines a height of the second side panel that approximates the height of the rear panel. Further, the second side panel defines opposing lateral edges, one of which contacts one of the lateral edges of the rear panel and the other of which contacts the front panel. Finally, the top panel extends from the leading edge of the rear panel to a leading edge opposite the rear panel, with this extension defining a length of the top panel. Further, the top panel extends from the leading edge of the second side panel to a lateral edge, thus defining a width of the top panel. With these conventions in mind, the lateral edge of the top panel is laterally spaced from a plane defined by the first side panel such that the width of the top panel is less than a width of the rear panel. In one preferred embodiment, the leading edge of the top panel is laterally spaced from a plane defined by the front panel to define a second gap.

Yet another aspect of the present invention relates to a method of storing and displaying packaged articles with a storage and display carton providing at least three display orientations.

DETAILED DESCRIPTION

Figure 2B:
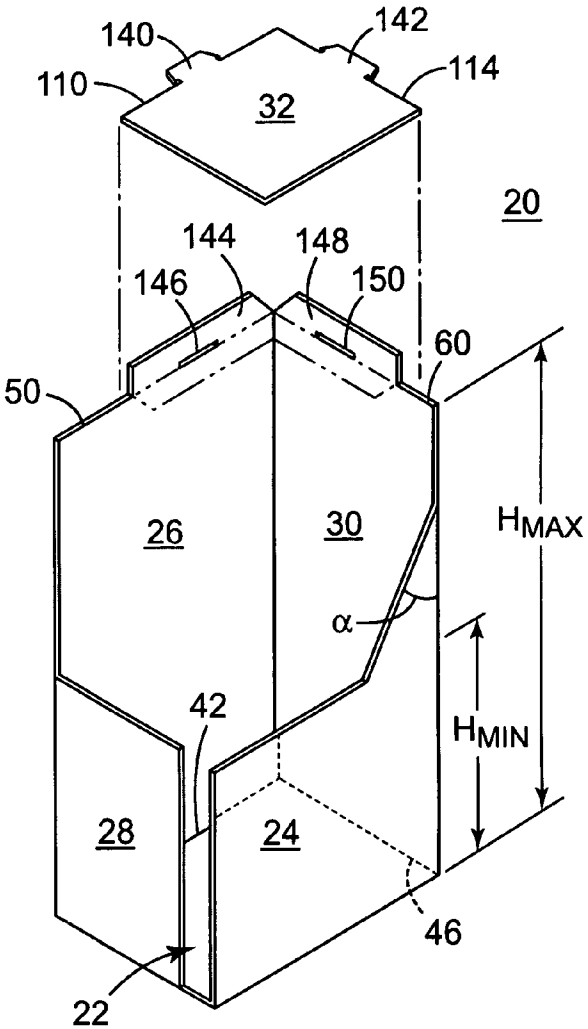
FIG. 2B is an exploded, perspective view of the carton of FIG. 1.
Figure 2A:
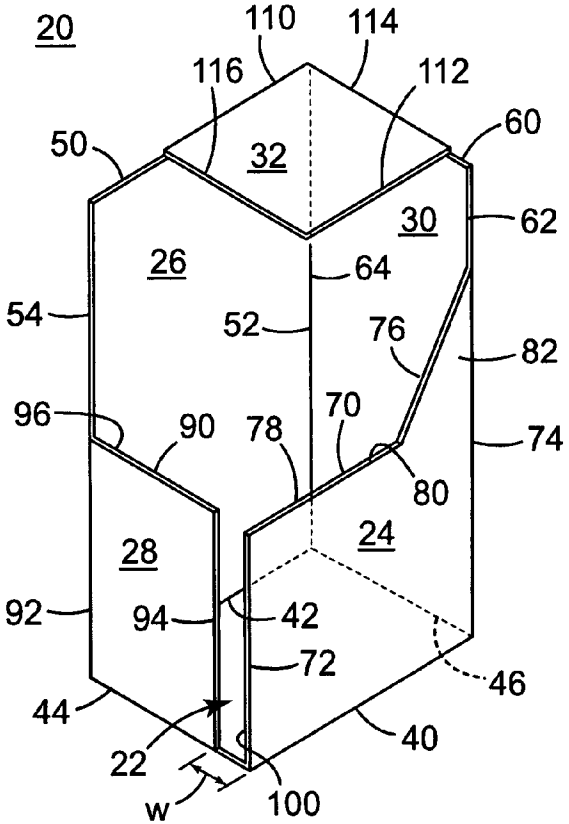
FIG. 2A is a perspective view of one embodiment of a storage and display carton in accordance with the present invention.

One embodiment of a storage and display carton 20 in accordance with the present invention is shown in FIGS. 2A and 2B. The carton 20 has a generally box-like shape, and includes a bottom panel 22, a front panel 24, a rear panel 26, a first side panel 28, a second side panel 30, and a top panel 32. As used throughout the specification, directional terminology, such as "top," "bottom," "front," "rear," "side," "leading," "trailing," "height," etc., is generally used with reference to the orientation of FIGS. 2A and 2B. Because the carton 20 of the present invention can be positioned in a number of different orientations, the directional terminology is used for purposes of illustration only, and is in no way limiting. In fact, as made clear below, the carton 20 provides a multitude of display orientations including one in which the top panel 32 effectively serves as a "front" panel. Further, the term "panel" is used in a general sense, referencing one or more contiguous layers that define(s) a common wall of the carton 20. Thus, for example, any of the "panels" 22-32 can be formed by a single, unitary layer, or by two or more adjacently positioned and/or overlying layers assembled to one another. For example, the bottom "panel" 22 can have a conventional form whereby two, three, or four flaps are folded to a partially overlying position, with at least two of the flaps being secured together (e.g., tape or adhesive), combining to define the bottom panel 22.

The panels 22-32 are described in greater detail below. In general terms, however, the bottom and top panels 22, 32 are opposed; the front and rear panels 24, 26 are opposed; and the first and second side panels 28, 30 are opposed. The front panel 24, the rear panel 26, and the first and second side panels 28, 30 are connected to or extend from the bottom panel 22. The second side panel 30 is connected to (or extends from), at opposite sides thereof, to the front and rear panels 24, 26. The first side panel 28 is connected to (or extends from) the rear panel 26. Finally, the top panel 32 is connected to (or extends from) the rear panel 26 and the second side panel 30 opposite the bottom panel 22. Upon final assembly, the carton 20 is adapted to provide at least three different display orientations in which contained articles (not shown) are at least partially visible and can be removed on an individual basis from the carton 20. To this end, as compared to the second side panel 30, the first side panel 28 facilitates display of contained articles such that for ease of understanding, the first side panel 28 is referred to herein as the "side display panel" and the second side panel 30 is referred to herein as the "side support panel".

For ease of illustration, not all element numbers in the description below are reflected in both FIGS. 2A and 2B. It will be understood, however, that any element number in one of FIG. 2A or 2B is equally applicable to other figure. With this in mind, the bottom panel 22 is defined by opposing first and second edges 40, 42, and opposing third and fourth edges 44, 46. As used herein, the term "edge" can be in reference to a discernable surface associated with a particular panel, or a common "edge" shared by adjacent panels (such as two panels folded relative to one another). With the embodiment of FIGS. 2A and 2B, the bottom panel 22 has a rectangular shape, such that the first and second edges 40, 42 have an approximately identical length and are longer than the third and fourth edges 44, 46, with the third and fourth edges 44, 46 being approximately identical in length. Alternatively, a multitude of other shapes and configurations are also acceptable. For example, the bottom panel 22 can be square, triangular, hexagonal, circular, irregularly shaped, etc.

The rear panel 26 and the side support panel 30 extend from the bottom panel 22 and define a maximum overall height (relative to the "upright" orientation of FIGS. 2A and 2B) of the carton 20. In particular, the rear panel 26 extends from the second edge 42 of the bottom panel 22 and defines a leading edge 50 opposite the bottom panel 22. In one embodiment, the carton 20 is formed by folding the rear panel 26 relative to the bottom panel 22, such that the second edge 42 is common to the bottom panel 22/rear panel 26. Regardless, the rear panel 26 further defines opposing first and second lateral edges 52, 54. The lateral edges 52, 54 extend in a generally perpendicular fashion relative to a plane of the bottom panel 22 in one embodiment.

Similarly, the side support panel 30 extends from the fourth edge 46 of the bottom panel 22, terminating in a leading edge 60 opposite the bottom panel 22. In one embodiment, the side support panel 30 is folded relative to the bottom panel 22, such that the fourth edge 46 is common to the bottom panel 22/side support panel 30. Regardless, the side support panel 30 further defines opposing first and second lateral edges 62, 64. In one embodiment, the side support panel 30 is folded relative to the rear panel 26, such that the corresponding lateral edges 52, 64 are commonly shared. That is to say, in one embodiment, the rear panel 26 and the side support panel 30 contact and extend from one another along a common edge 52, 64. Regardless, the lateral edges 62, 64 extend in a generally perpendicular fashion relative to a plane of the bottom panel 22.

As shown in FIGS. 2A and 2B, in one embodiment, the rear panel 26 and the side support panel 30 have an identical height ("$H_{MAX}$" in FIG. 2B). As will be understood by reference to FIGS. 2A and 2B, the height $H_{MAX}$ of the rear panel 26 is the dimension between the rear panel leading edge 50 and the bottom panel second edge 42; the height $H_{MAX}$ of the side support panel 30 is the dimension between the side support panel leading edge 60 and the bottom panel fourth edge 46. The rear panel 26 has a width defined as the dimension between the opposing lateral edges 52, 54 and is, in one embodiment, commensurate with a dimension of the bottom panel second edge 42 (i.e., in one embodiment, the rear panel 26 extends from an entirety of the bottom panel second edge 42). The side support panel 30 has a width defined as the dimension between the opposing lateral edges 62, 64, and is, in one embodiment, commensurate with a dimension of the bottom panel fourth edge 46 (i.e., in one embodiment, the side support panel 30 extends from an entirety of the bottom panel fourth edge 46). With the one embodiment of FIGS. 2A and 2B, that the rear panel 26 is wider than the side support panel 30. However, other configurations are equally acceptable.

The front panel 24 extends from the first edge 40 of the bottom panel 22, terminating in a leading edge 70 opposite the bottom panel 22. In addition, the front panel 24 defines opposing lateral edges 72, 74. In one embodiment, the front panel 24 is folded relative to the bottom panel 22, such that the first edge 40 is commonly shared by the bottom panel 22/front panel 24. Similarly, and in one embodiment, the front panel 24 is folded relative to the side support panel 30 such that the second lateral edge 74 of the front panel 30 is commonly shared with the lateral edge 62 of the side support panel 30. The front panel lateral edges 72, 74 (and thus the front panel 24) extend in a generally perpendicular fashion from the bottom panel 22 in one embodiment. As shown in FIG. 2A, in one embodiment a width of the front panel 24 (defined as the dimension between the lateral edges 72, 74) is commensurate with a dimension of the bottom panel end edge 40. However, a height of the front panel 24 is less than the height $H_{MAX}$ of the side support panel 30 (or the rear panel 26), establishing an opening 80 (referenced generally in FIG. 2A) into an interior of the carton 20.

In particular, the leading edge 70 of the front panel 24 extends from the first lateral edge 62 of the side support panel 30 at a point spaced from the side support panel leading edge 60. In one embodiment, an entirety of the front panel leading edge 70 is not parallel with the first edge 40 of the bottom panel 22. In particular, the front panel leading edge 70 can be described as including a first section 76 and a second section 78. The first section 76 extends from the side support panel 30, whereas the second section 78 extends from the first section 76, terminating at the lateral edge 72. With these designations in mind, the first section 76 extends in a non-perpendicular fashion relative to the second lateral edge 74, defining an angle $\alpha$ therebetween. The angle $\alpha$ is preferably in the range of 15-60°, although other dimensions are equally acceptable. Regardless, in one embodiment, the second section 78 extends in a parallel manner relative to the bottom panel first edge 40 (or perpendicular relative to the front panel lateral edge 72). With this one construction, then, the front panel 24 has an increased height along the first section 76 as compared to a height defined by the second section 78, such that the front panel 24 forms a support region 82. During use, and as described in greater detail below, the support region 82 serves to more completely retain articles (not shown) within the carton 20, whereas the lesser height ("$H_{MIN}$") associated with a remainder of the front panel 24 (i.e., the second section 78) facilitates viewing of the contained articles via the opening 80. Alternatively, an entirety of the front panel leading edge 70 can be oriented parallel with the bottom panel first edge 40.

The side display panel 28 extends in a generally perpendicular fashion from the third edge 44 of the bottom panel 22, terminating in a leading edge 90 opposite the bottom panel 22. In one embodiment, the side display panel 28 is folded relative to the bottom panel 22, such that the fourth edge 44 is commonly shared by the bottom panel 22/side display panel 28. As shown in FIG. 2A, a height of the side display panel 28 is defined as the dimension between the leading edge 90 and the fourth edge 44, and in one embodiment is substantially identical (e.g., within 0.5 inch) to the height $H_{MIN}$ of the front panel 24, although in other embodiments, the height of the side display panel 28 differs from that of the front panel 24. In addition, the side display panel 28 defines opposing first and second lateral edges 92, 94 that extend in a generally perpendicular fashion from the bottom panel 22. In one embodiment, the rear panel 26/side display panel 28 are folded relative to one another, such that the second lateral edge 54 of the rear panel 26 and the first lateral edge 92 of the side display panel 28 are commonly shared. Notably, however, a height (e.g., $H_{MIN}$) of the side display panel 28 is less than the height $H_{MAX}$ of the rear panel 26. In other words, the side display panel leading edge 90 extends from the rear panel 26 at a point spaced from the rear panel leading edge 50, establishing an opening 96 (referenced generally in FIG. 2A) into an interior of the carton 20.

As shown in FIGS. 2A and 2B, the second lateral edge 94 of the side display panel 28 does not contact, and is spaced from, the first lateral edge 72 of the front panel 24. In other words, the side display panel 28 has a width that is less than a dimension of the bottom panel first edge 44 from which the side display panel 28 otherwise extends. Thus, a first gap 100 is established between the front panel 24 and the side display panel 28. In one embodiment, the first gap 100 is bounded by, and extends to, the bottom panel 22. Regardless, and as described in greater detail below, a width W (defined by a distance between the lateral edges 72, 94) of the first gap 100 is sized in accordance with the contained articles (not shown) such that at least an individual one of the articles can be removed from the carton 20 via the first gap 100.

Finally, the top panel 32 extends in a generally perpendicular fashion from the leading edge 50 of the rear panel 26, and the leading edge 60 of the side support panel 30. The top panel 32 defines opposing trailing and leading edges 110, 112, and opposing first and second lateral edges 114, 116. In one embodiment, the top panel 32 is assembled to the rear and side support panels 26, 30 such that the trailing edge 110 is aligned with, or commonly shared by, the rear panel leading edge 50, and the first lateral edge 114 is aligned with, or commonly shared by, the side display panel leading edge 60. Regardless, the top panel leading edge 112 is positioned opposite the rear panel leading edge 50, and the top panel second lateral edge 116 is positioned opposite the side support panel leading edge 60.

In one embodiment, the top panel 32 has a width (i.e., dimension between the opposing lateral edges 114, 116) that is less than a dimension of the rear panel leading edge 50. Thus, the top panel second lateral edge 116 is spaced from the rear panel second lateral edge 54. Stated otherwise, and with additional reference to the simplified top view of FIG. 2C, the carton 20 can be viewed as having a side face 120 (referenced generally) defined, at least in part, by a plane of the first side display panel 28 (i.e., perpendicular to the plane of FIG. 2C). The top panel second lateral edge 116 is laterally spaced from the side face 120, establishing an opening 122 into an interior of the carton 20. As described in greater detail below, when the carton 20 is viewed from a top face 124 (referenced generally and otherwise established, at least in part, by a plane of the top panel 32), contained articles (not shown) can be viewed via the top opening 122.

Figure 2C:
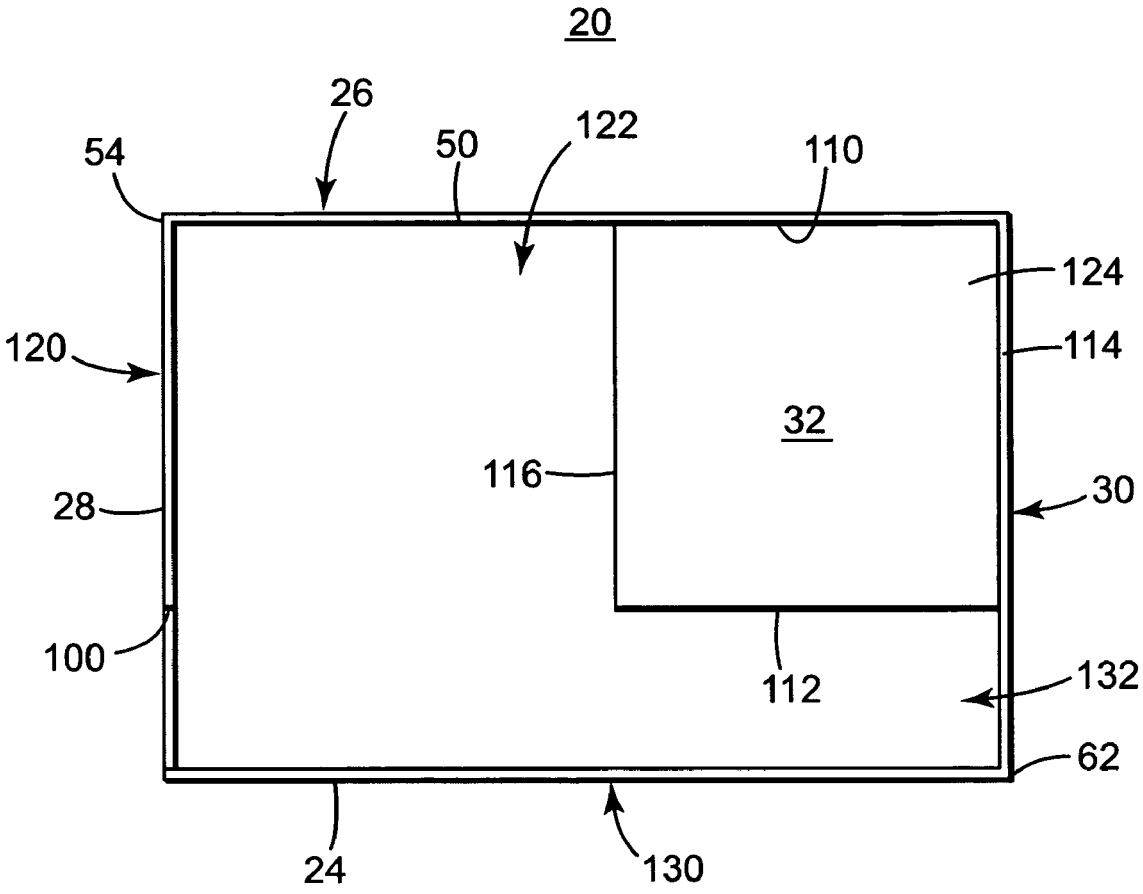
FIG. 2C is a top view of the carton of FIG. 1.

In addition, and with continued reference to FIGS. 2A and 2C, the carton 20 can further be described as having or defining a front face 130 (referenced generally in FIG. 2C) defined at least in part by a plane of the front panel 24. The top panel leading edge 112 is laterally spaced from the front plane 130 (i.e., the top panel leading edge 112 is laterally spaced from the first lateral edge 62 of the side support panel 30), establishing a second gap 132. In one embodiment, the second gap 132 is generally aligned with the first gap 100 (otherwise defined by the first side panel 28 and referenced generally in FIG. 2C). As described in greater detail below, the second gap 132 is sized in accordance with the contained articles (not shown) such that the second gap 132 facilitates removal of one or more articles from the carton 20.

The top panel 32 can be assembled to the rear panel 26/side support panel 30 in a variety of fashions. For example, in one embodiment and as best shown in FIG. 2B, the top panel 32 includes tabs 140, 142 formed along the trailing edge 110 and the first lateral edge 114, respectively. A first flap 144 forming an aperture 146 is provided as an extension from the leading edge 50 of the rear panel 26. Similarly, a second flap 148 forming an aperture 150 is provided as an extension from the leading edge 60 of the side support panel 30. The flaps 144, 148 are inwardly foldable relative to the respective leading edge 50, 60, with the folded position being shown with dashed lines in FIG. 2B. With this configuration, once the flaps 144, 148 are folded, the tab 140 is received within the aperture 146, and the tab 142 is received within the aperture 150, thus securing the top panel 32 relative to the rear panel 26/side support panel 30. Alternatively, a wide variety of other configurations are acceptable. For example, the top panel 32 can be glued or otherwise adhered to the rear panel 26/side support panel 30, thus eliminating the needs for the tabs 140, 142, and the flaps 144, 148.

Figure 3:
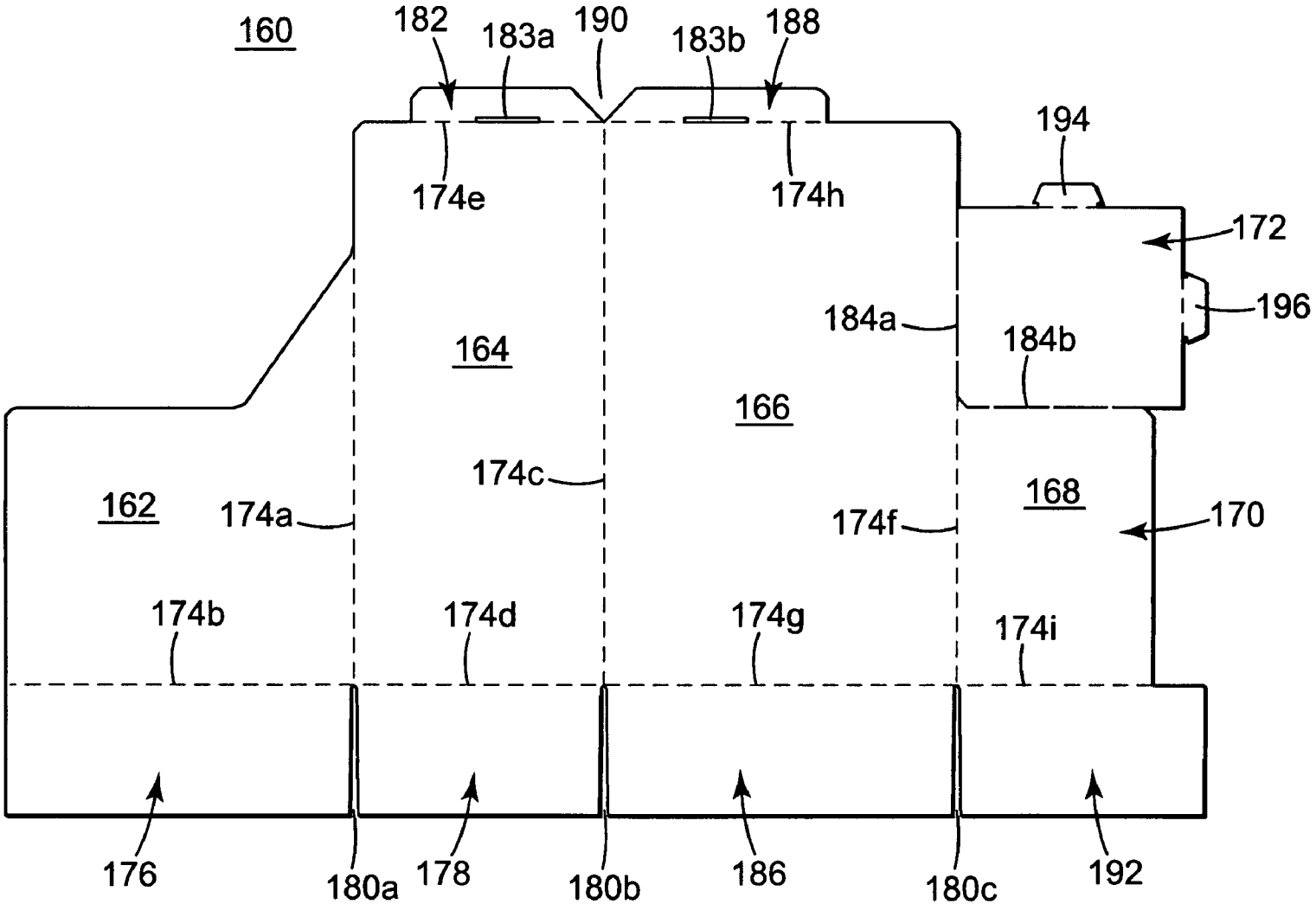
FIG. 3 is a plan view of a blank for forming the carton depicted in FIG. 2A.

FIG. 3 shows one embodiment of a blank 160 that can be used to manufacture the carton 20. Blank 160 is a flat, generally rectangular, one-piece blank that has been suitably cut and scored to enable subsequent folding of the blank into the carton 20 shown in FIGS. 2A and 2B. The blank 160 includes a series of minor and major panels, including first panel 162, second panel 164, third panel 166, and fourth panel 168. The fourth panel 168 includes a first portion 170 and a second portion 172. As a point of reference, the first, second, and third panels 162-166 become the front panel 24, side support panel 30, and the rear panel 26, respectively, of the carton 20 upon assembly. The first portion 170 becomes the side display panel 28 and the second portion 172 becomes the top panel 32 of the carton 20.

The first and second panels 162, 164 are connected at a fold line 174*a*. In addition, a first major flap 176 is connected to the first panel 162 via a fold line 174*b*. Fold lines are preferably defined by, but not limited to, crimping, some form of marking, or some other line-forming process, or adjacent elements of the blank 160 having a common edge. Alternatively, a partial-cut score line (e.g., cut to a depth of approximately 50% of the thickness of the blank 160 material) can be employed to define the "fold line". As used throughout the specification, the terms "fold" or "fold line" encompass any known technique for demarcating one panel/flap from an adjacent panel/flap in a manner that facilitates folding of the two components relative to one another.

The second panel 164 and the third panel 166 are connected at a fold line 174*c*. In addition, a second minor flap 178 extends from, and is connected to, the second panel 164 via a fold line 174*d*. A full cut 180*a* (i.e., a cut that extends through an entire thickness of the blank 160 material) laterally separates the first and second major flaps 176, 178 to allow each flap to be freely folded relative to the other. A first minor flap 182 extends from the second panel 164 opposite the second major flap 178, and is connected to the second panel 164 via fold line 174*e*. As a point of reference, the first minor flap 182 becomes the second flap 148 of FIG. 2B, and forms an aperture 183*a*.

The third panel 166 is connected to the first portion 170 of the fourth panel 168 via a fold line 174*f*. A perforation line 184*a* is formed between the third panel 166 and the second portion 172 of the fourth panel 168. As a point of reference, a perforation line or perforation cut is a paperboard cut that intermittently cuts through the entire thickness of the blank 160 material, while leaving intermittent pieces of the blank 160 material attached such that the second portion 172 can easily be removed from the third panel 166. In addition, a third major flap 186 extends from the third panel 166 as shown, and is connected thereto via a fold line 174*g*. The third major flap 186 is laterally spaced from a second major flap 178 by a full cut 180*b*. A second minor flap 188 extends from the third panel 166 opposite the third major flap 186. The second minor flap 188 and the third panel 166 are connected at a fold line 174*h*. As a point of reference, the second minor flap 188 forms the first flap 144 upon assembly of the carton 20 as shown in FIG. 2B, and defines an aperture 183*b*. A notch cut 190 separates the first and second minor flaps 182, 188.

With respect to the fourth panel 168, the first portion 170 and the second portion 172 are connected by a perforation line 184*b*. Thus, the second portion 172 can easily be removed from the first portion 170. In addition, a fourth major flap 192 extends from the first portion 170 opposite the second portion 172. The fourth major flap 192 and the first portion 170 of the fourth panel 168 are connected at a fold line 174*i*. Further, the fourth major flap 192 is laterally separated from the third major flap 186 by a full cut 180*c*. As a point of reference, the major flaps 176, 178, 186, and 192 combine to define the bottom panel 22 of the carton 20 (FIG. 2A). Finally, the second portion 172 includes tabs 194, 196 (akin to the tabs 140, 142 of FIG. 2B) that facilitate assembly of the carton 20 (FIG. 2B) as previously described.

With the above-described perforation lines 184*a*, 184*b*, the second portion 172 of the fourth panel 168 can be removed from a remainder of the blank 160 during assembly of the blank 160 as the carton 20 (FIG. 2A). Thus, the second portion 172 serves as the top panel 32 of the carton 20.

Figure 1:
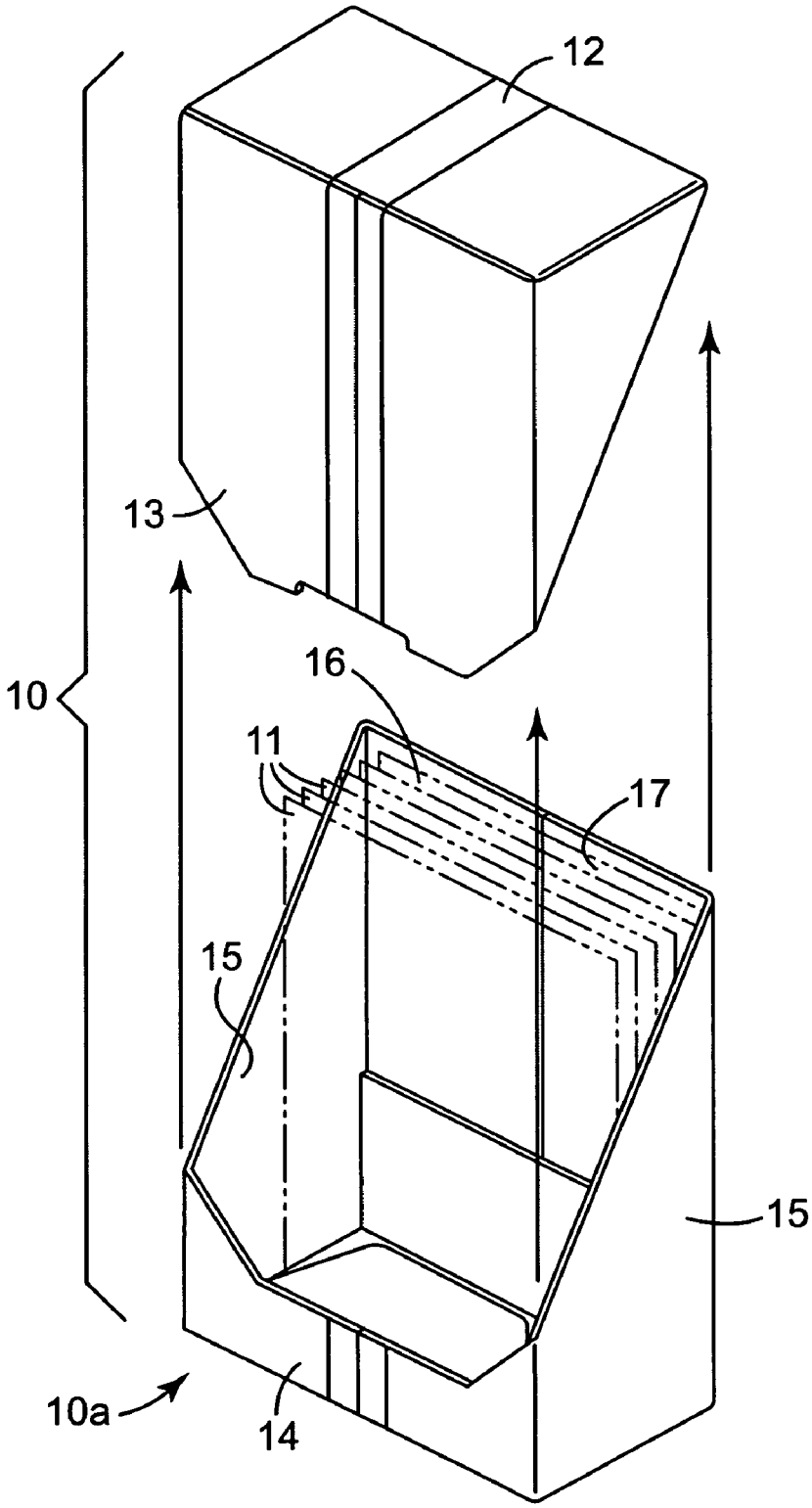
FIG. 1 Prior Art
FIG. 1 is a perspective view of a prior art storage and display carton.
Figure 4:
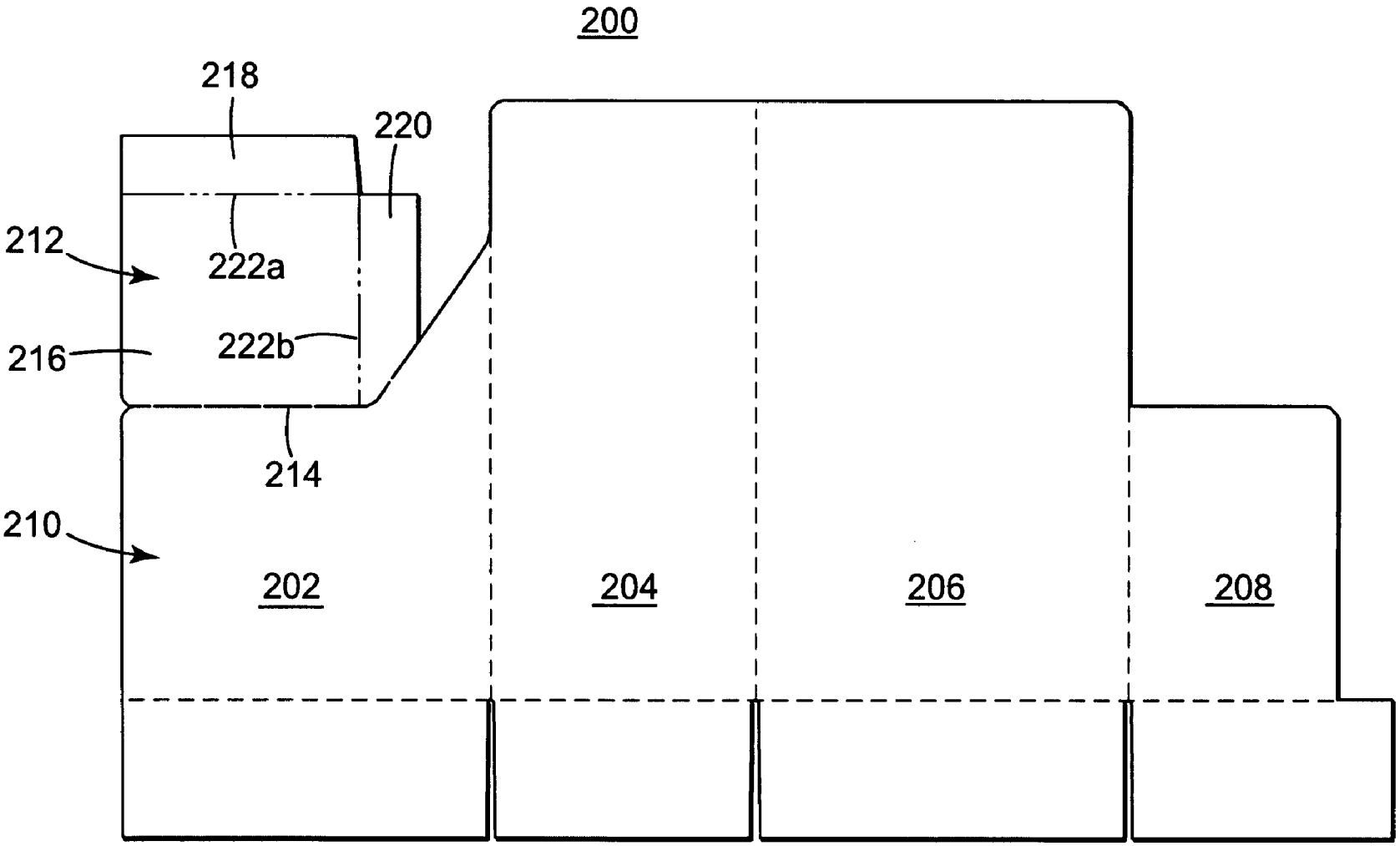
FIG. 4 is a plan view of an alternative embodiment blank for forming an alternative embodiment carton in accordance with the present invention.

The blank 160 described above is but one acceptable configuration for forming cartons in accordance with the present invention. An alternative embodiment blank 200 useful for forming the carton 20 (FIG. 2A) in accordance with the present invention is shown in FIG. 4. The blank 200 is highly similar in many respects to the blank 160 (FIG. 3). The blank 200 includes first, second, third, and fourth panels 202-208. The first panel 202 includes a first portion 210 and a second portion 212. The first and second portions 210, 212 are connected to one another along a perforation line 214. Thus, the second portion 212 can be removed from the first portion 210, with the second portion 212 serving as the top panel 32 (FIG. 2B) of the carton 20 upon final assembly. In addition, the second portion 212 includes a body 216, and flaps 218, 220. The flaps 218, 220 are connected to the body 216 along fold lines 222*a*, 222*b*, respectively. With this configuration, then, the flaps 218, 220 can be folded relative to the body 216 and subsequently glued or otherwise adhered to the second and third panels 204, 206, thus completing assembly of the top panel 32 (FIG. 1B) to a remainder of the carton 20.

The blanks 160 (FIG. 3), 200 are but two examples of possible configurations for viably forming the carton 20 (FIG. 2A) of the present invention. A variety of other blank configurations are equally acceptable. For example, the top panel 32 (FIG. 2B) can be formed entirely separate from the material blank otherwise used to form the remaining panels. Alternatively, the blank can be configured such that one or more other flaps or panels extend from the second panel (164, 204) and/or the third panel (166, 206) that otherwise form the top panel 32 via simple folding.

Figure 5:
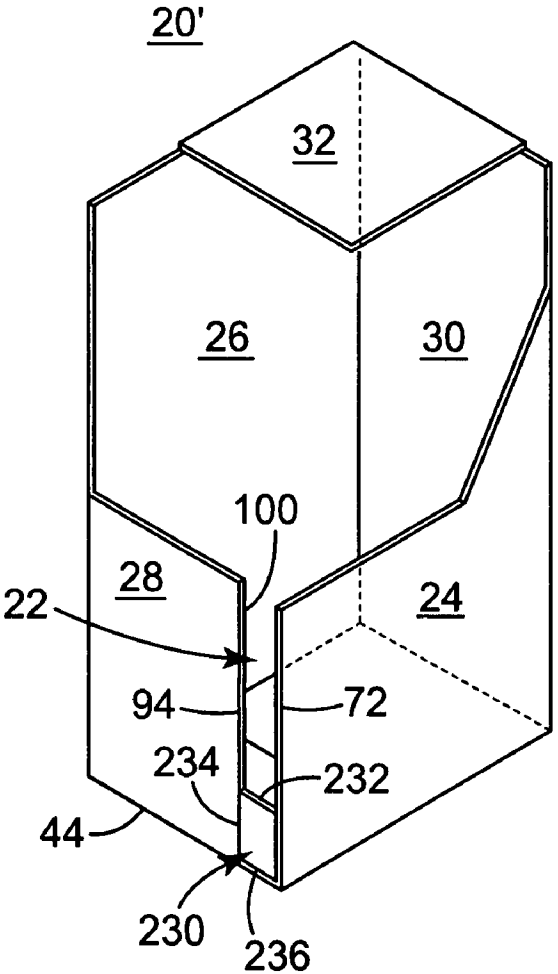
FIG. 5 is perspective view of an alternative embodiment carton in accordance with the present invention.

In addition to varying techniques for forming the carton of the present invention, the carton itself may include additional features. For example, FIG. 5 illustrates an alternative embodiment carton 20' in accordance with the present invention. The carton 20' includes the panels 22-32 previously described. In addition, the carton 20' includes a temporary support body 230. The temporary support body 230 extends from the side edge 94 of the side display panel 28 to the side edge 72 of the front panel 24. In addition, the temporary support body 230 extends from the side edge 44 of the bottom panel 22, terminating in a leading edge 232 opposite the bottom panel 22. In one embodiment, the temporary support body 230 is initially formed as part of the panel otherwise generating the side display panel 28, and is separable therefrom via a perforation line 234. In addition, the temporary support body 230 is connected to a section of the bottom panel 22, such as the fourth major flap 192 (FIG. 3), again along a perforation line 236. With this configuration, the temporary support body 230 encompasses a portion of the first gap 100 (referenced generally in FIG. 5), preventing undesired dislodgement of contained articles (not shown) during shipping. In addition, a supporting member (not shown) such as packaging tape, can be used to connect the side display panel 28, the temporary support body 230, and the front panel 24, thus reinforcing the carton 20 at the first gap 100 during shipping. Regardless, in a final display state of the carton 20', the temporary support tab 230 is removed from the carton 20 (via the perforation lines 234, 236), thus completing the first gap 100.

Figure 6:
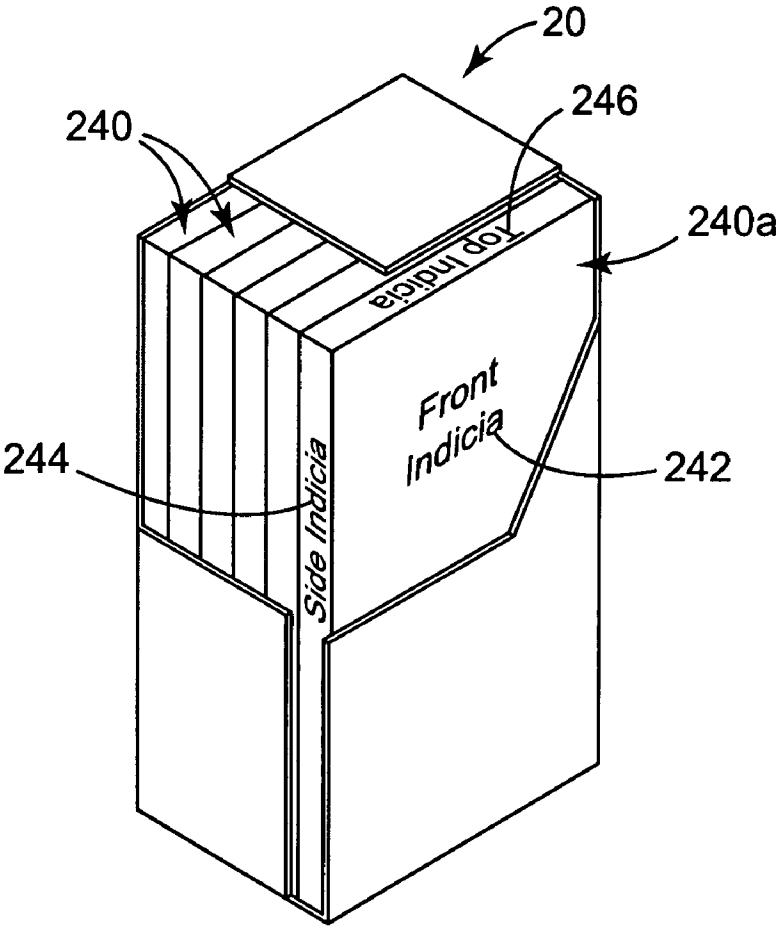
FIG. 6 is a perspective view of the carton of FIG. 2A loaded with a plurality of packaged articles.

Regardless of exact configuration, the carton of the present invention provides a retailer with at least three different, viable display orientations. As a point of reference, FIG. 6 depicts the carton 20 of the present invention loaded with a plurality of articles 240 (illustrated generically in the figures). The articles 240 can assume a wide variety of forms. For example, but in no way limiting, the articles 240 can be individually packaged air cleaning filters (available from 3M Company of St. Paul, Minn. in a variety of sizes (e.g., 16 inches×25 inches×1 inch) and sold individually or in multi-product packages). Dimensions of the carton 20 are dictated by exterior shape, dimensions, and/or indicia of the individual articles 240 and by retailer preferences. With the one exemplary embodiment of FIG. 6, the articles 240 each have a rectangular shape, with the carton 20 having corresponding dimensions to interiorly secure the articles 240. In alternative embodiments, the articles 240 can have other shapes, such that the carton 20 will also vary from the shape illustrated. Regardless, the articles 240 are commonly loaded (e.g., in series) within the carton 20, and each can include front indicia 242, side indicia 244, and top indicia 246 (shown for the article 240*a* positioned adjacent the front panel 24).

Figure 7C:
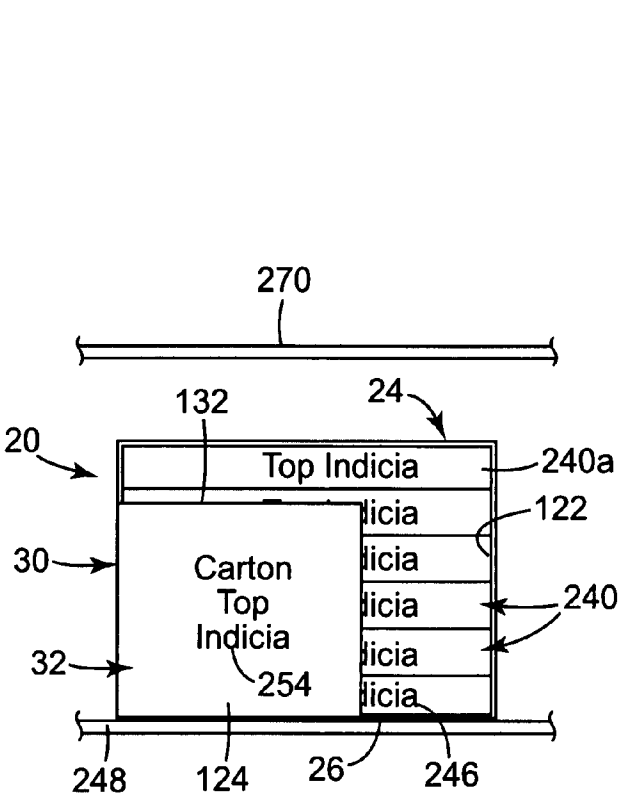
FIG. 7C is a top view of the loaded carton of FIG. 6.
Figure 7B:
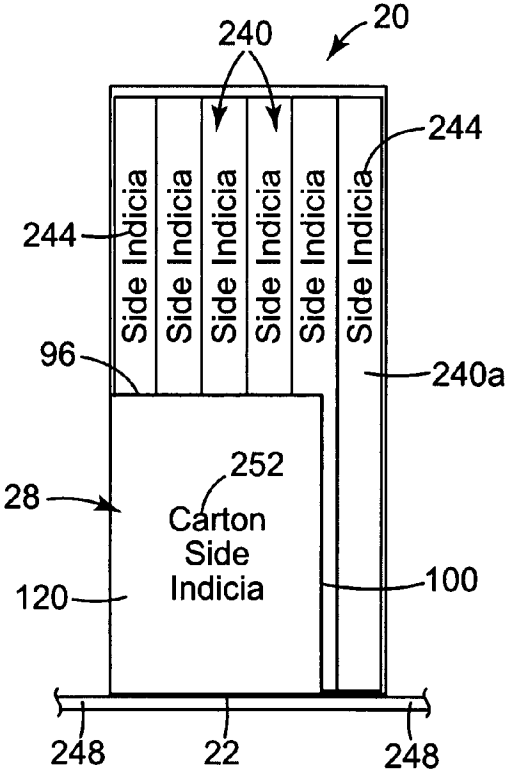
FIG. 7B is a side view of the loaded carton of FIG. 6.
Figure 7A:
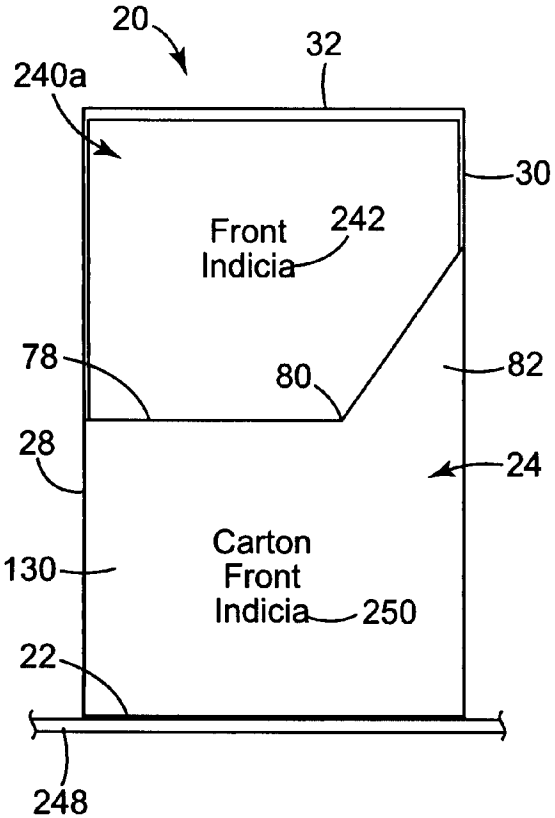
FIG. 7A is a front view of the loaded carton of FIG. 6.

In a first display orientation, the bottom panel 22 (referenced generally) rests on a support surface 248, such as a shelf, and the front panel 24 (and thus the front face 130) "faces" viewers/consumers as shown in FIG. 7A. The front indicia 242 of the first article 240*a* is readily perceived or viewed by consumers via the opening 80 (referenced generally) established by the front panel 24. To this end, the front panel 24 can include indicia 250 that describes or corresponds with the articles 240 and/or their packaging scheme (i.e., the carton panel indicia 250 can mimic or supplement the front indicia 242 of the article 240*a*). Notably, the support region 82 of the front panel 24 prevents the articles 240 from accidentally falling out of the carton 20 (especially as one or more of the articles 240 are removed from the carton 20 and the remaining "grouping" of articles 240 naturally tilts toward the front panel 24), but does not overtly obscure viewing of the front indicia 242. The height of the front panel 24 along the second section 78 relative to a height of the articles 240 can vary. In one embodiment, the front panel 24 has a height (along the second section 78) approximately one-half to one-fourth a height of the articles 240 to adequately maintain the articles 240 within the carton 20, yet still permit viewing of the front indicia 242.

Where desired, the first article 240*a* can be removed from the carton 20 via sliding through the second or top gap 132 (FIG. 2C) and/or the first or side gap 100 (FIG. 2A) as described below. In the first display orientation of FIG. 7A, additional, article-loaded cartons 20 (not shown) can be placed on either side of the carton 20 (left and/or right relative to the orientation of FIG. 7A) in close proximity thereto, thus minimizing shelf space requirements while still allowing easy removal of contained article(s) via the second gap 132.

A second display orientation of the carton 20 is shown in FIG. 7B. Again, the bottom panel 22 (referenced generally) rests on the support surface 248, such as a shelf. The side display panel 28 (and thus the side face 120) "faces" or is viewable by a consumer. With this orientation, the side indicia 244 of the articles 240 is viewable or perceivable by the consumer via the opening 96 (referenced generally) provided by the side display panel 28. That is to say, the side display panel 28 prevents accidental dislodgement of the articles 240 from the carton 20, yet does not overtly obscure viewing of the side indicia 244. Thus, while a height of the side display panel 28 relative to a height of the articles 240 can vary, in one embodiment, the side display panel 28 has a height approximately one-half to one-fourth a height of the articles 240 to adequately maintain the articles 240 within the carton 20, yet still permit viewing of the side indicia 244. In one embodiment, the side display panel 28 includes indicia 252 describing or corresponding with the articles 240 and/or their packaging scheme (i.e., the carton side indicia 252 can mimic or supplement the side indicia 244 of the articles 240).

Where desired, one of the articles 240 (such as the article 240*a*) can be removed from the carton 20 in this side panel viewing orientation via the first gap 100. As previously alluded, the first gap 100 has a width commensurate with (e.g., slightly larger than) a width of individual ones of the packaged articles 240. Thus, individual ones of the articles 240 can be removed from the carton 20 via the first gap 100, yet the side display panel 28 prevents others of the articles 240 from accidentally spilling or dislodging from the carton 20. Because the articles 240 can be removed from the carton 20 via the first gap 100, a series of similarly oriented cartons can be placed side-by-side (i.e., in close proximity to the carton 20 shown in FIG. 7B, to the right and/or left thereof), yet consumers are easily able to remove desired article(s) from the respective carton 20 via the corresponding first gap 100, thus resulting in a reduction of shelf space requirements.

A third display orientation available with the carton 20 of the present invention is shown in FIG. 7C. With this orientation, the rear panel 26 (referenced generally) rests on the support surface 248, such as a shelf, with the top panel 32 (and thus the top face 124) "facing" a viewer/consumer. The top panel 32 prevents undesired dislodgement or sliding of the articles 240 from the carton 20. However, even after one or more of the articles 240 have been removed from the carton 20, the top indicia 246 of each of the articles 240 can still be viewed or perceived via the opening 122 (referenced generally). That is to say, the top panel 32 does not overtly obstruct viewing of the top indicia 246. In one embodiment, the top panel 32 includes indicia 254 describing or corresponding with the articles 240 and/or their packaging scheme (i.e., the carton top indicia 254 can mimic or supplement the top indicia 246 of the articles 240).

Where desired, one of the articles 240 (such as the article 240*a*) can be removed from the carton 20 via sliding through the second gap 132. In this regard, and as alluded above, the second gap 132 has a width commensurate with (e.g., slightly larger than) a thickness of individual ones of the articles 240. With this configuration, then, retailers can position the carton 20 as shown in FIG. 7C between closely spaced shelves. For example, a second shelf 270 can be located "above" (relative to the orientation of FIG. 7C) the carton 20 with minimal clearance therebetween (on the order of 1-3 inches). Thus, retailers can obtain a significant savings in vertical shelf spacing requirements.

Figure 8:
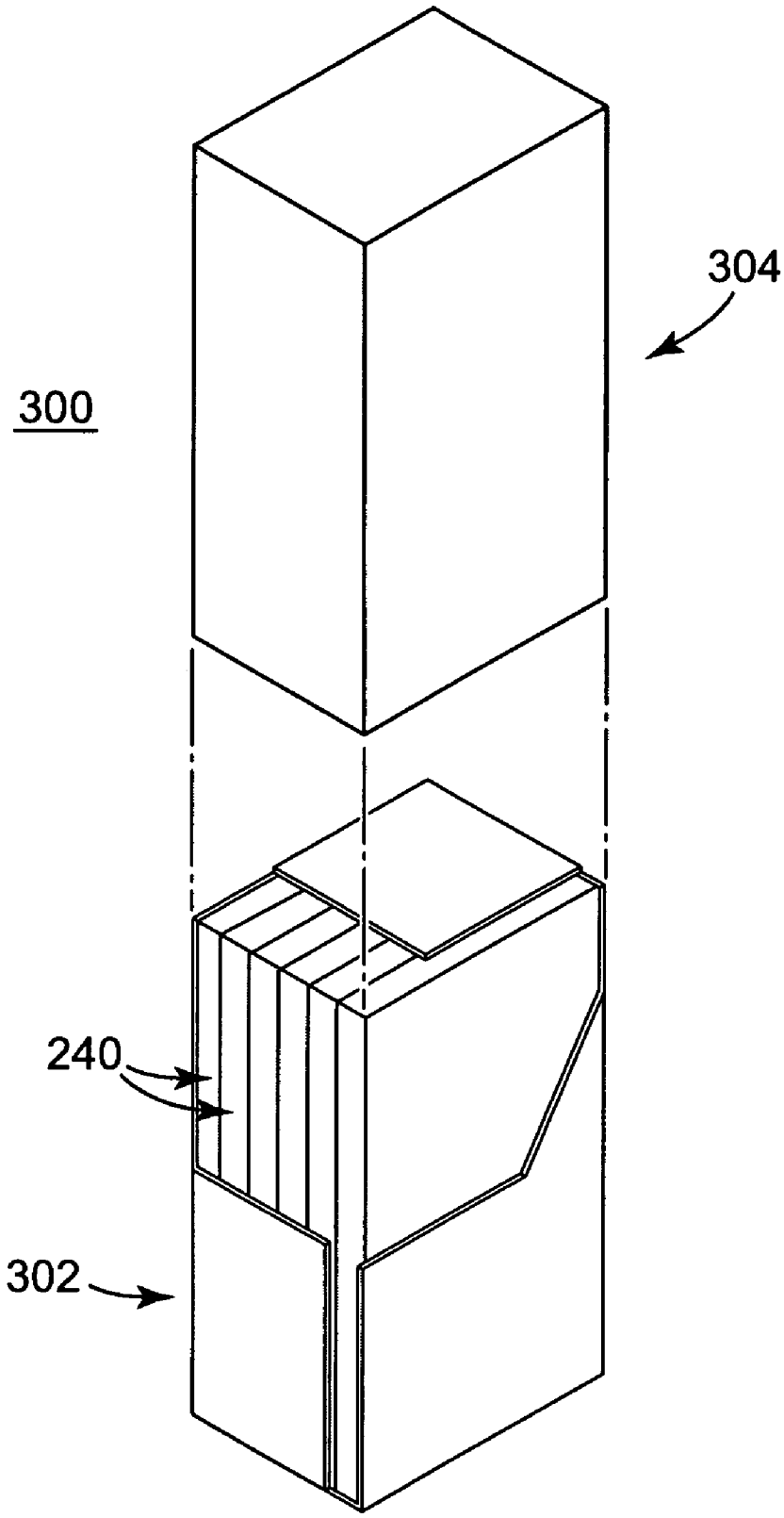
FIG. 8 is a perspective view of an alternative embodiment carton loaded with articles in accordance with the present invention.

The carton 20/articles 240 can be stored and displayed in the state shown in FIG. 6. Further, the carton 20/articles 240 can be shipped in this format. In an alternative embodiment, however, a separate cover is provided. For example, FIG. 8 illustrates an alternative embodiment carton 300 loaded with the articles 240. The carton 300 includes a container 302 (akin to the carton 20 of FIG. 1) along with a cover 304. The cover 304 is sized to be slidably or telescopically received over the container 302 during shipping. Subsequently, the cover 304 can be removed, with the container 302/articles 240 displayed as previously described.

The carton and related method of use of the present invention provides a marked improvement over previous designs. By providing three highly viable display orientations in which contained articles are fully supported yet easily removable and visible, retailers are afforded the ability to use the carton in whatever orientation best meets their shelving requirements. Further, manufacturers can utilize a single design to satisfy the varying display needs of different retail customers without having to generate a multitude of different carton designs.

Although reference has been made to preferred embodiments, workers skilled in the art will recognize that changes can be made in form and detail without departing from the spirit and scope of the present invention.

What is claimed is:

1. A carton for storing and displaying a plurality of articles, the carton comprising:

a bottom panel;

opposing front and rear panels extending from opposing first and second edges of the bottom panel;

opposing first and second side panels extending from opposing third and fourth edges of the bottom panel; and a top panel extending from the rear and second side panels opposite the bottom panel;

wherein a first gap is defined at and between a lateral edge of the first side panel, a lateral edge of the front panel, and the third edge of the bottom panel;

wherein the carton is configured to permit viewing of contained product from a front face at least partially defined by the front panel, a side face at least partially defined by the first side panel, and a top face at least partially defined by the top panel;

and further wherein the first side panel defines a height relative to an extension thereof from the bottom panel, and the rear panel defines a height relative to an extension thereof from the bottom panel, and wherein the height of the first side panel is less than the height of the rear panel to define an opening in the side face.

2. The carton of claim 1, wherein the front panel defines a front plane of the carton, and further wherein the top panel defines a leading edge opposite the rear panel, the leading edge being laterally spaced from the front face to form a second gap through which a contained article can be removed from the carton.

3. The carton of claim 2, wherein the second gap is generally aligned with the first gap.

4. The carton of claim 2, wherein an intersection line is defined at an intersection of the front plane and with a top face major plane defined by the top panel, and further wherein the second gap is open at the intersection line.

5. The carton of claim 1, wherein the front panel defines a height relative to an extension thereof from the bottom panel, and the second side panel defines a height relative to an extension thereof from the bottom panel, and further wherein the height of the front panel is less than the height of the second panel to define an opening in the front face.

6. The carton of claim 5, wherein the front panel defines a leading edge opposite the bottom panel, and the second side panel defines a leading edge opposite the bottom panel and a lateral edge opposite the rear panel, and further wherein the leading edge of the front panel extends from the lateral edge of the second side panel at a point spaced from the leading edge of the second side panel.

7. The carton of claim 6, wherein the leading edge of the front panel includes a first section extending from the second side panel and a second section extending from the first section, and further wherein the first section extends from the second side panel towards the bottom panel and the second section extends approximately parallel to a major plane of the bottom panel.

8. The carton of claim 5, wherein an intersection line is defined at an intersection of a front face major plane defined by the front face with a top face major plane defined by the top panel, and further wherein the opening is continuous and uninterrupted from a leading edge of the front panel to, and including, the intersection line.

9. The carton of claim 1, wherein the first side panel defines a leading edge opposite the bottom panel, and the rear panel defines a leading edge opposite the bottom panel and a lateral edge opposite the second side panel, and further wherein the leading edge of the first side panel extends from the lateral edge of the rear panel at a point spaced from the leading edge of the rear panel.

10. The carton of claim 1, wherein the top panel defines a width relative to an extension thereof from the second side panel, and the rear panel defines a width relative to an extension thereof from the second side panel, and further wherein the width of the top panel is less than the width of the rear panel to define an opening in the top face.

11. The carton of claim 10, wherein the top panel defines a lateral edge opposite the second side panel, and the rear panel defines a lateral edge opposite the second side panel and a leading edge opposite the bottom panel, and further wherein the lateral edge of the top panel extends from the leading edge of the rear panel at a point spaced from the lateral edge of the rear panel.

12. The carton of claim 1, further comprising:

a removable cover apart from the top panel.

13. The carton of claim 1, wherein an intersection line is defined at an intersection of a first side face major plane defined by the first side panel with a top face major plane defined by the top panel, and further wherein the lateral edge of the top panel is spaced from the intersection line to define an opening in the top face, the opening including the intersection line.

14. The carton of claim 1, wherein:

the front panel extends from the second side panel to define a lateral edge opposite the second side panel;

wherein the first side panel extends from the rear panel to define a lateral edge opposite the rear panel;

and further wherein at least a portion of the lateral edge of the front panel is spaced from at least a portion of the lateral edge of the first side panel to define the first gap.

15. The carton of claim 14, wherein the non-contacting portions of the lateral edges of the front panel and the first side panel extend perpendicular relative to a major plane of the bottom panel.

16. The carton of claim 14, wherein the first gap is defined in the side face of the carton.

17. The carton of claim 16, wherein the first gap extends to the bottom panel.

18. The carton of claim 17, further comprising:

a temporary support body extending between the lateral edge of the front panel, the lateral edge of the first side panel, and the third edge of the bottom panel;

wherein in a final display state, the temporary support body is removed such that the front panel, the first side panel, and the bottom panel define the first gap.

19. A combination carton and articles, the combination comprising:

a carton including:

a bottom panel, opposing front and rear panels extending from opposing first and second edges of the bottom panel, opposing first and second side panels extending from opposing third and fourth sides of the bottom panel, a top panel extending from the rear and side panels opposite the bottom panel, wherein a first gap is defined between corresponding lateral edges of the first side panel and the front panel, and further wherein the carton has a front face at least partially defined by the front panel, a side face at least partially defined by the first side panel, and a top face at least partially defined by the top panel; and a plurality of articles contained within the carton including a first article abutting the bottom panel and the front panel, each of the articles having substantially identical outer dimensions of length, width, and thickness;

wherein the carton is configured such that at least one of the contained articles is visible from an exterior of the carton at the front face, the side face, and the top face;

wherein the first gap is configured to facilitate sliding removal of the first article from the carton along the bottom panel and the front panel, and through the first gap;

and further wherein the carton and articles are configured such that the first side panel extends from and defines a height relative to the bottom panel, the height being less than a height of the rear panel to define an opening in the side face of the carton through which at least one of the articles is visible.

20. The combination carton and articles of claim 19, wherein the first gap has a width commensurate with an outer dimension of one of the articles.

21. The combination carton and articles of claim 20, wherein the first gap extends to the bottom panel.

22. The combination carton and articles of claim 19, wherein the top panel defines a second gap relative to the front face, the second gap and outer dimensions of individual ones of the plurality of articles being configured such that at least one article can be removed from the carton through the second gap.

23. The combination carton and articles of claim 19, wherein the carton and articles are configured such that the front panel extends from and defines a height relative to the bottom panel, the height being less than a height of the second side panel to define an opening in the front face of the carton through which at least one of the articles is visible.

24. The combination carton and articles of claim 23, wherein the plurality of articles are arranged in series within the carton such that a major face of a first one of the articles is adjacent the front panel, and further wherein the height of the front panel is less than a height of the major face.

25. The combination carton and articles of claim 19, wherein the plurality of articles are arranged in series within the carton such that a corresponding side of each article is adjacent the first side panel, and further wherein the height of the first side panel is less than a height of each of the corresponding sides of the articles.

26. The combination carton and articles of claim 19, wherein the carton and articles are configured such that the top panel extends from and defines a width relative to the second side panel, the width being less than a width of the rear panel to define an opening in the top face of the carton through which at least one of the articles is visible.

27. The combination carton and articles of claim 26, wherein the plurality of articles are arranged in series within the carton such that a corresponding top of each article is adjacent the top panel, and further wherein the width of the top panel is less than a length of each of the corresponding tops of the articles.

28. The combination carton and articles of claim 19, wherein the combination carton and articles are configured to provide:

a first display orientation in which the bottom panel rests on a surface and the front face is viewable, wherein at least one of the contained products is visible through the front face and can be removed from the carton through the first gap or a second gap in the top face;

a second display orientation in which the bottom panel rests on a surface and the side face is viewable, wherein at least one of the contained products is visible through the side face and can be removed from the carton through at least one of the first gap and the second gap; and a third display orientation in which the second side panel rests on a surface and the top face is viewable, wherein at least one of the contained product is visible through, and can be removed from the carton through the top face.

29. A carton for storing and displaying a plurality of articles, the carton comprising:

a bottom panel having opposing first and second edges and opposing third and fourth edges;

a rear panel extending from the second edge to form a rear face major plane of the carton consisting solely of the rear panel, the rear panel defining opposing lateral edges and a leading edge opposite the bottom panel, extension from the bottom panel to the leading edge defining a height of the rear panel;

a front panel extending from, and along an entirety of, the first edge of the bottom panel opposite the rear panel to form a front face major plane of the carton consisting solely of the front panel, the front panel having a leading edge opposite the bottom panel, to define a height of the front panel, and opposing lateral edges, wherein the height of the front panel is less than the height of the rear panel such that the front panel and the rear panel have differing outer dimensions, and further wherein the height of the front panel differs at the opposing lateral edges thereof;

a first side panel extending from, and along a portion of, the third edge of the bottom panel and defining a leading edge opposite the bottom panel, to define a height of the first side panel, and opposing lateral edges, one of which contacts the rear panel and the opposing one of which is spaced from the front panel to define a first gap such that a width of the first side panel is less than a dimension of the bottom panel third edge from which the first side panel extends;

a second side panel extending from, and along an entirety of, the fourth edge of the bottom panel opposite the first side panel and defining a leading edge opposite the bottom panel, to define a height of the second side panel, and opposing lateral edges, one of which contacts one of the lateral edges of the rear panel and the opposing one of which contacts the front panel, wherein the height of the second side panel approximates the height of the rear panel; and a top panel extending from the leading edge of the rear panel to a leading edge opposite the rear panel to define a length of the top panel and extending from the leading edge of the second side panel to a lateral edge to define a width of the top panel, wherein the lateral edge of the top panel is laterally spaced from a plane defined by the first side panel such that the width of the top panel is less than a width of the rear panel.

30. The carton of claim 29, wherein the leading edge of the top panel is laterally spaced from a plane defined by the front panel to define a second gap.

31. The carton of claim 29, further comprising:

a temporary support body interconnecting the lateral edge of the front panel, the lateral edge of the first side panel, and the third edge of the bottom panel, and connected to at least one of the edges along at least one perforation line;

wherein in a final display state, the temporary support body is removed such that the front panel, the first side panel, and the bottom panel define the first gap.

* * * * *